US006773225B2

(12) United States Patent
Yuri et al.

(10) Patent No.: US 6,773,225 B2
(45) Date of Patent: Aug. 10, 2004

(54) GAS TURBINE AND METHOD OF BLEEDING GAS THEREFROM

(75) Inventors: Masanori Yuri, Takasago (JP); Vincent Laurello, Miami, FL (US); Charles Ellis, Miami, FL (US); Mitsuhiro Noguchi, Takasago (JP); Keita Fujii, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 77 days.

(21) Appl. No.: 10/156,922

(22) Filed: May 30, 2002

(65) Prior Publication Data

US 2003/0223856 A1 Dec. 4, 2003

(51) Int. Cl.[7] ..... F01D 5/18
(52) U.S. Cl. ..... 415/1; 415/115
(58) Field of Search ..... 415/1, 115, 116, 415/175, 176, 185, 202

(56) References Cited

U.S. PATENT DOCUMENTS 4,541,774 A * 9/1985 Rieck et al. ..... 415/115
4,822,244 A * 4/1989 Maier et al. ..... 415/115
5,997,244 A 12/1999 Gebre-Giorgis et al. .... 415/115
2002/0076318 A1 * 6/2002 Patel ..... 415/115

FOREIGN PATENT DOCUMENTS

JP 7-324633 12/1995
JP 3165611 3/2001

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

In order to provide a gas turbine and a gas bleeding method which can prevent the loss of drive power due to gas bleeding to the rotor disk, bleed gas is imparted with swirling flow in the same rotational direction as that of a first stage rotor disk by being passed through a set of TOBI nozzles which constitute a flow conduit therefor, and is supplied to this first stage rotor disk, with a portion of this bleed gas flow being bypassed and being supplied between first stage stationary blades and first stage moving blades.

4 Claims, 3 Drawing Sheets

GAS TURBINE AND METHOD OF BLEEDING GAS THEREFROM

BACKGROUND OF THE INVENTION

1. Field of the Invention

The present invention is related to a gas turbine, and to a gas bleeding method for a gas turbine, which perform sealing between moving blades and stationary blades by supplying bleed gas from, for example, a compressor, while cooling the moving blades.

2. Description of the Related Art

In a gas turbine plant, compressed air from a compressor is fed to a combustor, wherein it is combusted along with fuel to generate high temperature gas, which is conducted to a gas turbine so as to drive said gas turbine. And there is a per se known structure in which, at this time, a portion of this compressed air is conducted as bleed gas to a cooling device, and after being cooled this bleed gas is next fed to stationary blades and moving blades on the gas turbine side, so that this bleed gas is utilized for cooling of these moving blades and secondary blades, and for sealing between these moving blades and secondary blades. An example of a structure in such a prior art gas turbine for supplying bleed gas to the stationary blades and the moving blades of a first stage unit will now be described in the following with reference to FIG. 3. This figure is a partial axial cross sectional view showing a bleed gas flow conduit to the first stage unit of the gas turbine, and it should be understood that a compressor which is not shown in the drawing and lies beyond the extreme left margin of the drawing paper disposed coaxially with the gas turbine.

In this figure, the reference numeral 1 indicates a set of first stage moving blades, while the reference numeral 2 indicates a set of first stage stationary blades. A plurality of first stage moving blades 1 are disposed in circular arrangement around the periphery of a rotor disk 3 which is mounted coaxially with the compressor, and this first stage rotor disk 3 rotates by receiving the impulse of combustion gas from said compressor. Furthermore, a plurality of first stage stationary blades 2 are disposed in a circular arrangement so as to be coaxial with the first stage rotor disk 3, on near side of the turbine casing. Thus a first stage unit 4 is constituted, comprising these first stage moving blades 1, this first stage rotor disk 3, and this first stage stationary blades 2.

Furthermore, the reference numeral 5 in the figure indicates a bleed gas chamber which takes in a flow f1 of bleed gas from the previously described cooler after said bleed gas flow has been cooled, and almost all of this bleed gas flow f1 which has been taken into the bleed gas chamber 5 is conducted to the first stage moving blades 1 via a cooling flow conduit 3*a* which is formed in the first stage rotor disk 3, and thus functions to cool these first stage moving blades 1 from their insides. That is, the cooling flow conduit 3*a* is a flow conduit which is formed in roughly an "L" shape between the upstream side surface of the first stage rotor disk main body 3*b* (the surface thereof which confronts the first stage stationary blades 2) and a flow conduit partition wall 3*c* which is fixed by bolts to said upstream side surface; and, after a cooling air flow f2 has been taken in along the direction of the rotational axis of the first stage rotor disk 3 from the bleed gas flow f1 being expelled from the bleed gas chamber 5, next this cooling air flow f2 is expelled along the radial direction with respect to said rotational axis as a center.

This flow conduit partition wall 3*c* is a tubular member which partitions the flow f1 of bleed gas from the bleed gas chamber 5 into two flows, the aforesaid cooling air flow f2 and a sealing air flow f3; and a labyrinth seal 6 is formed upon its outer circumferential surface, between the flow conduit partition wall 3*c* and a division wall 2*a*1 which is held by the inner circumferential side of an inner shroud 2*a* of the first stage secondary blades 2.

A portion of the bleed gas flow f1 is separated to constitute said sealing air flow f3, which is then supplied between the first stage moving blades 1 and the first stage secondary blades 2; and this labyrinth seal 6 functions to seal these gaps C.

However, such a prior art type gas turbine suffers from the problems explained below. That is, the bleed gas flow f1 which is supplied from the bleed gas chamber 5 has hardly any rotational speed component around the circumferential direction of said rotational axis taken as a center, and, since it enters into the disk holes 3*a*1 which are formed in the cooling flow conduit 3*a* (a plurality of perforations which are formed so as to radiate from said rotational axis) in this same state, there is the problem of occurrence of drive power loss.

That is, although the each cooling flow conduit 3*a* rotates at high speed together with the first stage rotor disk 3 which is the main rotating body, since the cooling air flow f2 which has hardly any high rotational velocity component in the circumferential direction with respect to the first stage rotor disks 3 in this high speed rotating state flows in and passes through the first stage for disk 3, accordingly this flow of cooling air f2 undesirably exerts a braking force to restrain the rotational operation of the first stage rotor disk 3; and, moreover, the drive power required for rotating the rotating body which includes the first stage rotor disk 3 is undesirably increased. It is desirable to eliminate the rotational power loss by all means possible, since this type of drive loss entails an undesirable reduction in the electric generating capacity of a generator (not shown in the figures) which is connected to the gas turbine.

SUMMARY OF THE INVENTION

The present invention has been made in consideration of the above described problems, and its objective is to provide a gas turbine and a gas bleeding method therefor, which are capable of preventing loss of drive power due to gas bleeding to the rotor disk.

The present invention utilizes the following means for solving the problems detailed above.

Namely, the gas turbine described in a first aspect of the present invention comprises a plurality of stationary blades arranged in a circular manner on near side of a turbine casing, a plurality of moving blades arranged in circular manner on near side of a rotor disk adjoining the stationary blades, a swirling flow creation section which supplies to the rotor disk bleed gas which has been input, after imparting the bleed gas with a swirling flow which rotates in the same rotational direction as that of the rotor disk, and a seal gas supply flow conduit which supplies a portion of the bleed gas to a gap between the stationary blades and the moving blades, bypassing the swirling flow creation section.

According to the gas turbine specified in the first aspect of the present invention as described above, the flow of bleed gas is supplied towards the rotor disk after having been imparted with a swirling flow by passing through the swirling flow creation section, and therefore it becomes possible to greatly reduce the relative rotational speed difference between the two of them (the rotor disk and the bleed gas flow) in the rotational direction of the rotor disk. Moreover, the bleed gas flow for sealing between the stationary blades and the moving blades is arranged to flow within the seal gas supply flow conduit, thus not interfering with the above described swirling flow in the swirling flow creation section.

Furthermore, a gas turbine described in a second aspect of the present invention, the swirling flow creation section comprises a plurality of TOBI nozzles (Tangential OnBoard Injection Nozzle) which reduce the flow conduit cross sectional area while swirling from the outside in the radial direction towards the inside, around the rotational axis of the rotor disk as a center; and the seal gas supply flow conduit is formed so as to pass between the TOBI nozzles.

According to the gas turbine specified in the second aspect of the present invention as described above, it is possible to impart a swirling action to the flow of gas towards the rotor disk in a reliable manner. Furthermore, it becomes possible to supply the bleed gas for sealing to the gap between the stationary blades and the moving blades without hampering this swirling flow.

A gas bleeding method described in a third aspect of the present invention, in a bleeding method for gas turbine which comprises a plurality of stationary blades arranged in a circular manner on near side of a turbine casing, a plurality of moving blades arranged in a circular manner on near side of a rotor disk adjoining the stationary blades; and in this method, bleed gas is supplied to the rotor disk after being imparted with a swirling flow which rotates in the same rotational direction as that of the rotor disk; and a portion of the bleed gas is supplied between the stationary blades and the moving blades bypassing the swirling flow.

According to the gas bleeding method specified in the third aspect of the present invention as described above, since the flow of bleed gas is supplied towards the rotor disk after having been imparted with a swirling flow, it becomes possible to greatly reduce the relative rotational speed difference between the two of them in the rotational direction of the rotor disk. Moreover, the bleed gas flow for sealing between the stationary blades and the moving blades does not interfere with the above described swirling flow.

DETAILED DESCRIPTION OF THE PREFERRED EMBODIMENTS

Figure 1:
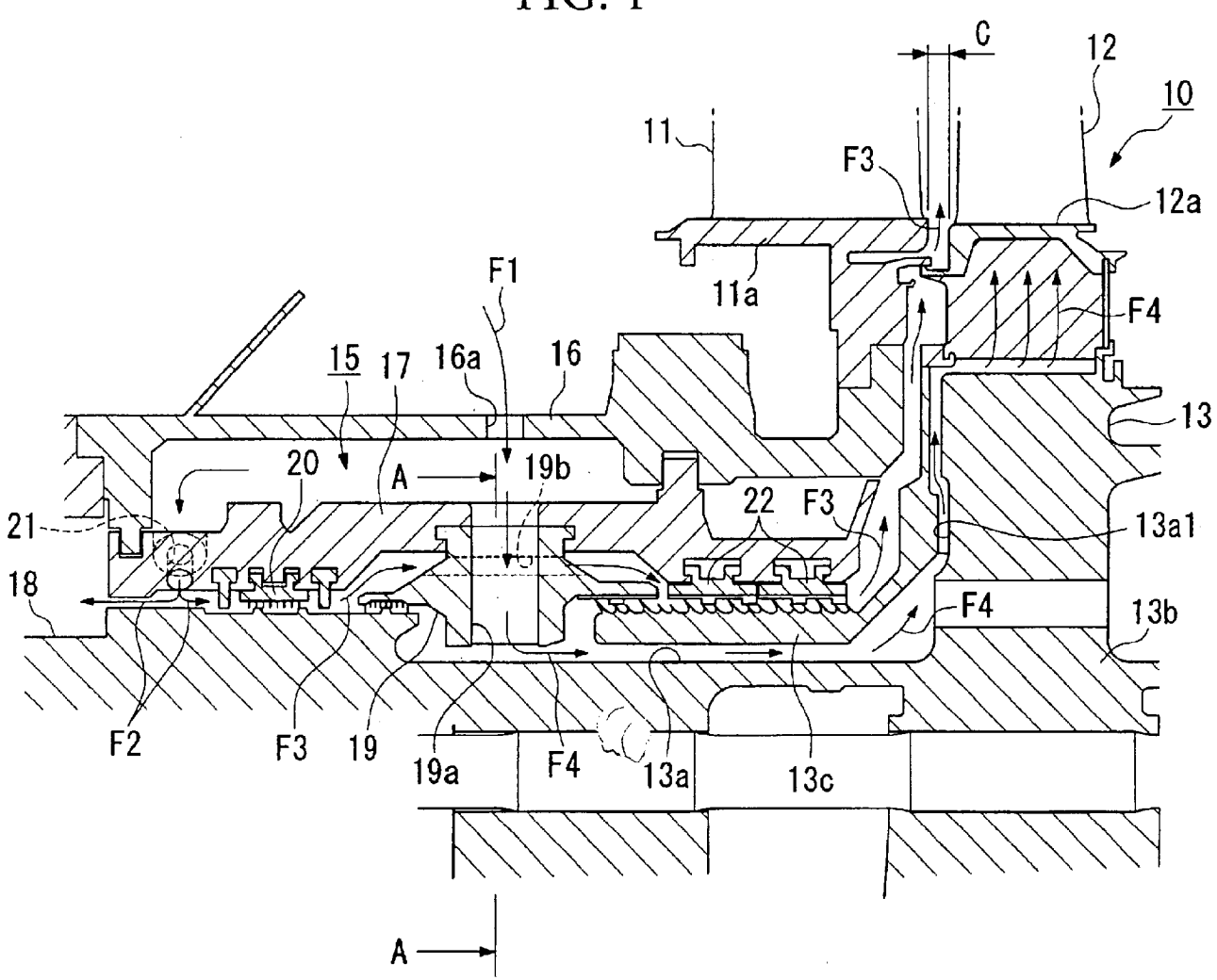
FIG. 1 is a partial cross section showing a bleed gas flow conduit to a first stage unit which is incorporated in the preferred embodiment of the gas turbine according to the present invention.
Figure 2:
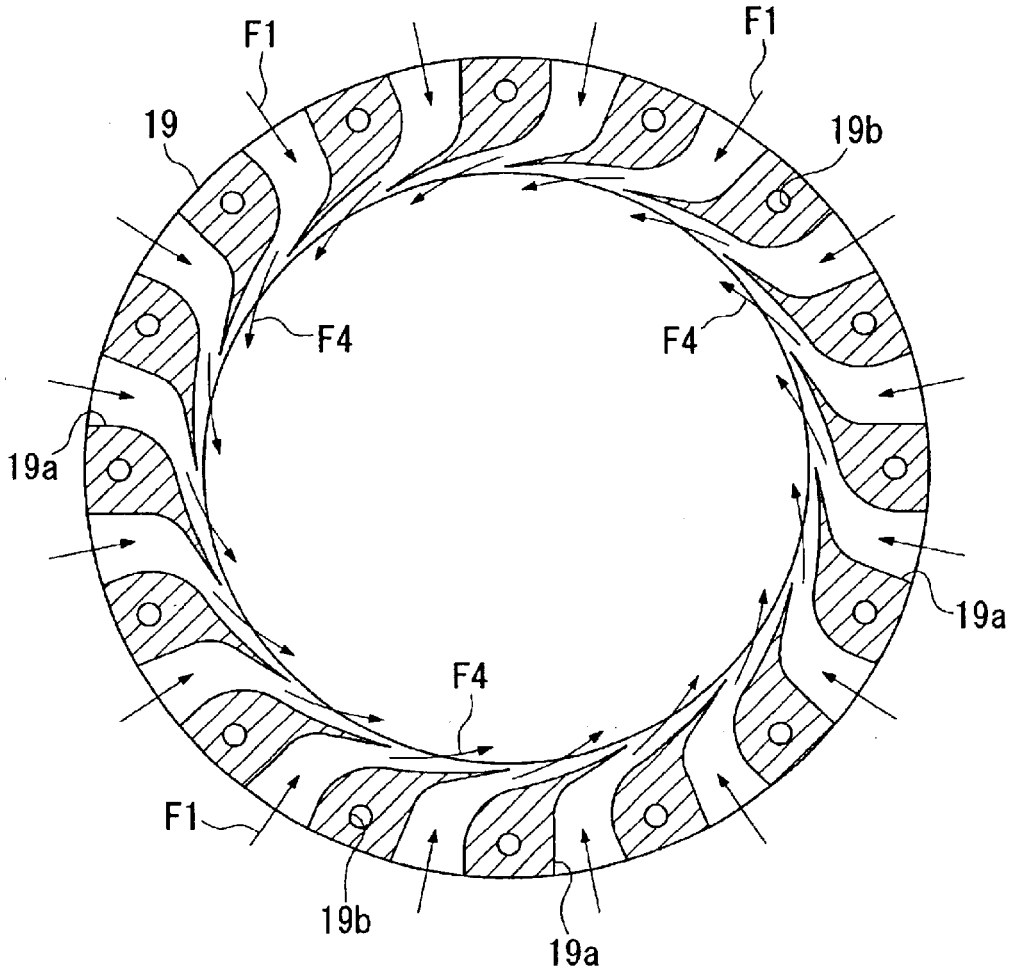
FIG. 2 is a cross section of the structure in FIG. 1 taken in a plane shown by the arrows A—A, and shows certain essential elements of this portion of this gas turbine.
Figure 3:
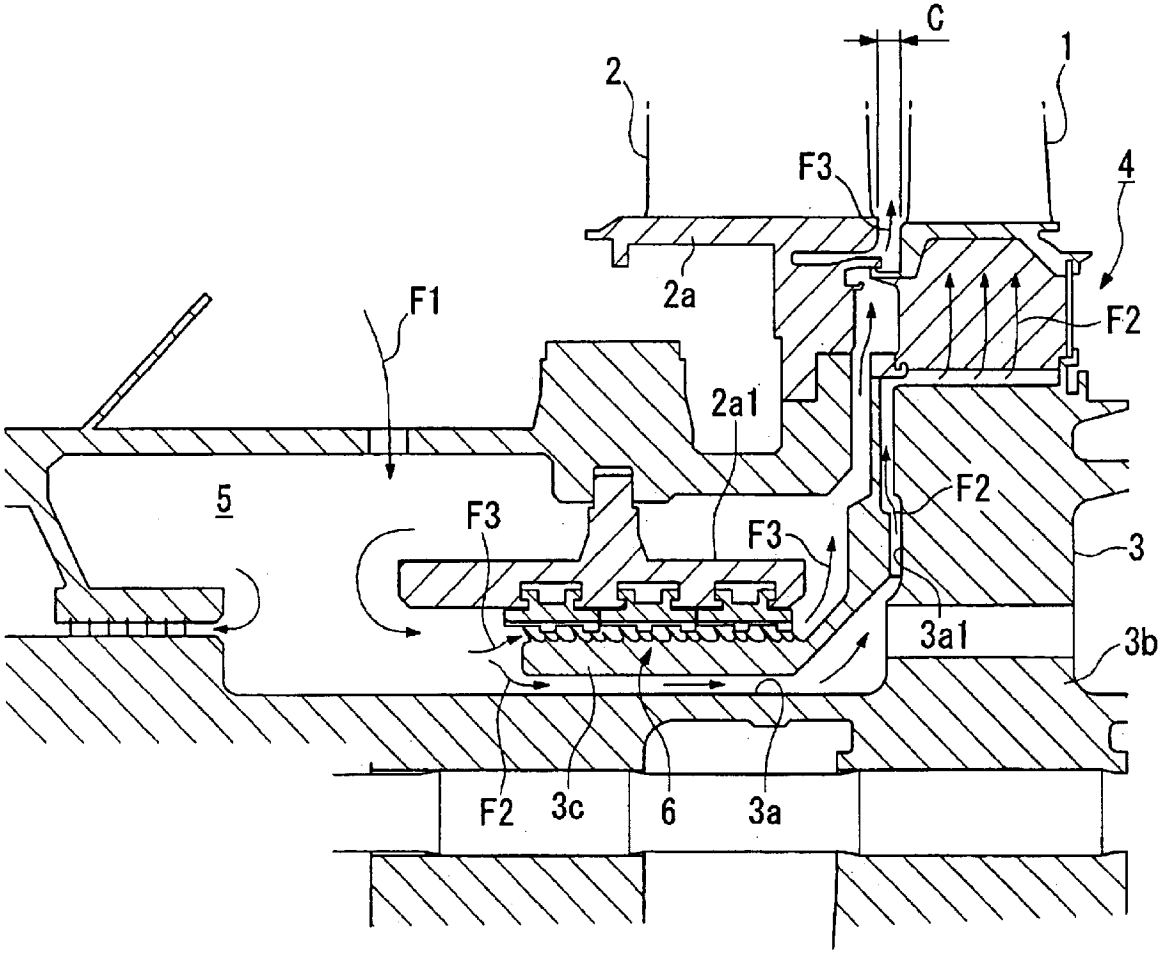
FIG. 3 PRIOR ART
FIG. 3 is a partial cross section similar to the FIG. 1 showing a bleed gas flow conduit to a first stage unit which is incorporated in a conventional gas turbine.

Although preferred embodiments of the gas turbine according to the present invention, and of the gas bleeding method of the present invention, will be described hereinafter with reference to FIGS. 1 and 2, of course the present invention is not to be considered as being limited to the preferred embodiments described. In the figures, FIG. 1 is a partial cross section showing a gas bleed flow conduit to a first stage unit which is incorporated in the preferred embodiment of the gas turbine according to the present invention. FIG. 2 is a cross section of the structure of FIG. 1 taken in a plane shown by the arrows A—A in FIG. 1, and shows certain essential elements of this portion of this gas turbine.

Furthermore, in the following explanation, the upstream side with respect to the bleed gas flow direction (the left side in FIG. 1) will be referred to as the "upstream side", while conversely the downstream side with respect to the bleed gas flow direction (the right side in FIG. 1) will be referred to as the "downstream side". Furthermore, the direction of the rotational axis of a main rotational member which includes a first stage rotor disk 13 (the left to right direction upon the FIG. 1 drawing paper) will be referred to as the "axial direction".

As shown in FIG. 1, the gas turbine according to this preferred embodiment of the present invention comprises a first stage unit 10 which comprises a plurality of first stage stationary blades 11 which are arranged in a circular manner on near side of a turbine casing, a first stage rotor disk 13 which is adjacent to these first stage stationary blades 11, and a plurality of first stage moving blades 12 which are arranged in a circular manner around the periphery of this first stage rotor disk 13. It should be understood that a second stage unit and a third stage unit (neither of which is shown in the figures) having the same structure as this first stage unit 10 are disposed on the downstream side thereof, with these three units being arranged coaxially and being mutually contacted together so that the stationary blades and moving blades of each stage mutually alternate along the axial direction.

The first stage moving blades 12 are arranged in plurality around the periphery of the first stage rotor disk 13, and rotationally drive the first stage rotor disk 13 by receiving combustion gas from a combustor not shown in the drawings. Furthermore, the first stage stationary blades 11 are arranged in plurality in the interior of the turbine casing in circular manner, so as to be coaxial with the first stage rotor disk 13.

The rotor disks of each stage, including this first stage rotor disk 13, are mutually coaxially superimposed so as to constitute a single rotor which, via a connection rotor member 18, is coaxially connected to a rotor of a compressor (neither being shown in the figures) which is provided at its upstream side.

The reference numeral 15 in the figures indicates a bleed gas chamber for taking in bleed gas which has been received from said compressor after it has been cooled by a cooler not shown in the figures, and this bleed gas chamber 15 is formed as a circular space which is defined between a first division wall 16 fixed to the inward side of an inner shroud 11*a* of the first stage stationary blades 11, and a second division wall 17 which is held further to the inward side of this first division wall 16.

A plurality of bleed gas introduction apertures 16*a* are formed in the first division wall 16 around the rotational axis of the rotor disks, and bleed gas F1 from the cooler is introduced into the bleed gas chamber 15 via these bleed gas introduction apertures 16*a*.

The second division wall 17 is a tubular shaped element which is arranged coaxially around the periphery of the first stage rotor disk 13 and the connection rotor 18, and which is kept in a stationary state inside the first division wall 16. Furthermore, to the inner circumferential surface of this second division wall 17, at a central position in its widthwise direction (its axial direction), there is fixed a nozzle ring 19 (which will be explained in detail hereinafter) in which are formed a plurality of TOBI nozzles 19*a* (Tangential OnBoard Injection nozzles). A first seal portion 20 is fixed to the inner circumferential surface of the second division wall 17 further to the upstream side than the position of the nozzle ring 19 (a brush seal or a labyrinth seal may also be used). Furthermore, to the upstream side, a nozzle 21 is formed which injects a portion of the bleed gas F1 in the bleed gas chamber 15 towards the outer circumferential surface of the connection rotor 18. On the other hand, a pair of second seal portions 22 are fixed to the inner circumferential surface of the second division wall 17 further to the downstream side than the position of the nozzle ring 19 (a brush seal or a labyrinth seal may also be used).

The first seal portion 20 and the nozzle 21 constitute a seal mechanism for preventing ingress of high temperature air from the compressor, and function to suppress ingress of said high temperature air by a sealing air flow F2 being discharged from the nozzle 21. And a portion of this sealing air flow F2 flows to the downstream side of the first seal portion 20, so as to constitute a sealing air flow F3 towards the gap C between the first stage moving blades 12 and the first stage stationary blades 11.

Almost all of the bleed gas F1 which enters into the bleed gas chamber 15 is conducted to the first stage moving blades 12 via a cooling flow conduit 13*a* which is formed in the first stage rotor disk 13, and functions to cool these first stage moving blades 12 from their insides.

The cooling flow conduit 13*a* is a flow conduit of approximately "L" shape which is formed between the upstream side surface of the first stage rotor disk main body 13*b* (the surface on the side thereof which opposes the first stage stationary blades 11) and a flow conduit partition wall 13*c* which is fixed by bolts to said upstream side surface. The bleed gas F1 from the bleed gas chamber 15 comes to be introduced via said TOBI nozzles 19*a* into this cooling flow conduit 13*a,* thus constituting a cooling air flow F4 which has been put into the swirling flow state, and this cooling air flow F4, while still remaining in the swirling state, flows in the direction of the rotational axis of the first stage rotor disk 13, and thereafter its direction of flow is angled around towards the radial direction with respect to this rotational axis as a center.

The flow conduit partition wall 13*c* is a circular member which partitions between the seal air flow F3 and the cooling air flow F4, and said second seal portions 22 are provided between its outer circumferential surface and the inner circumferential surface of said second partition wall 17. A sealing air flow F3 which has passed through these second seal portions 22 is supplied between the first stage moving blades 12 and the first stage stationary blades 11 after flowing along the outer circumferential surface of the flow conduit partition wall 13*c,* and functions to seal the gap C between these blades 12 and 11.

A gas turbine according to the preferred embodiment of the present invention is particularly characterized by the feature that the bleed gas flow f1 which has been taken into the bleed gas chamber 15 is directed into the cooling flow conduits 13*a* sealing air flow F3 is supplied into the gap C between the first stage stationary blades 11 and the first stage moving blades 12, thus avoiding the cooling air flow F4 which is in the swirling flow state.

In other words, as shown in FIG. 2, the nozzle ring 19 is formed in a circular shape as seen in the cross section perpendicular to said axial direction, and moreover, taking its axial center (in other words, the rotational axis of the first stage rotor disk 13) as a center, a plurality of said TOBI nozzles 19*a* are formed thereupon at approximately mutually equal angular intervals, with their flow conduit cross sectional areas gradually getting smaller along the radial direction from the outside to the inside while they swirl. At the time in which that the bleed gas flow F1 which has entered into the TOBI nozzles 19*a* from the periphery of this nozzle ring 19 (in other words from the bleed gas chamber 15) and has passed along its radial direction towards its center has been discharged from the inner circumferential side of the nozzle ring 19, it becomes a swirling flow (the cooling air flow F4) which is rotating in the same rotational direction as the first stage rotor disk 13, since its direction has changed gradually by being directed along the curved shape of the TOBI nozzles 19*a*.

The cooling air flow F4 which has been made to swirl in this manner enters, while maintaining this swirling state, into a plurality of disk holes 13*a*1 (perforations extending in a radiant pattern with said rotational axis as a center—refer to FIG. 1) which are formed in the cooling flow conduit 13*a*. At this time, the disk holes 13*a*1 are rotating at high speed together with the first stage rotor disk 13 as a rotating body, but, since the cooling air flow F4 which enters into these holes 13*a*1 is rotating at high speed in the same manner and in the same direction, accordingly it is possible very much to reduce the relative speed difference between them in the rotational direction of the first stage rotor disk 13, so that the cooling air flow F4 does not act in any way to apply any braking action upon the driving of the first stage rotor disk 13.

After the cooling air flow F4 has passed through the disk holes 13*a*1, it flows into flow conduits which are formed in the first stage moving blades 12, and it thus proceeds to cool of these first stage moving blades 12 from their insides.

On the other hand, since the sealing air flow F3 passes through the sealing gas supply flow conduits 19*b* shown in FIGS. 1 and 2 towards the gap C, it does not interfere with the cooling air flow F4 or disturb its swirling flow state.

The sealing gas supply flow conduits 19*b* are a plurality of bypass flow conduits which are pierced through the nozzle ring 19 from its upstream side towards its downstream side in its axial direction, and they are formed so as to pass between the plurality of TOBI nozzles 19*a*. A sealing air flow F3 which has arrived at the upstream side surface of this seal ring 19 from said nozzles 21 through the first seal portion 20 flows out to the downstream side of the seal ring 19 through these seal gas supply flow conduits 19*b*. At this time, the sealing air flow F3 passes without interfering with the cooling air flow F4 which is flowing through the TOBI nozzles 19*a*. Moreover, after the sealing air flow F3 has passed through the second seal portion 22, it flows along the wall surface of the flow conduit partition wall 13*c,* and eventually flows out into the combustion gas flow conduit through the gap C between the inner shroud 12*a* of the first stage moving blades 12 and the inner shroud 11*a* of the first stage stationary blades 11, so as to provide a sealing action by preventing any leakage of the combustion gas which is flowing in this combustion gas flow conduit out through the gap C to the outside.

The gas turbine according to the preferred embodiment of the present invention explained above employs the shown construction which comprises the plurality of TOBI nozzles 19*a* which supply the bleed gas flow F1 which has been taken into the bleed gas chamber 15 to the first stage rotor disk 13, after it has been imparted with a swirling flow which rotates in the same rotational direction as that of said first stage rotor disk 13, and the seal gas supply flow conduits 19*b* which supply a portion of the bleed gas flow F1 to the gap C between the first stage stationary blades 11 and the first stage moving blades 12, bypassing the TOBI nozzles 19*a*. According to this structure, the cooling air flow F4 towards the first stage rotor disk 13 is supplied to the first stage rotor disk 13 after having been imparted with a swirling flow by passing through the TOBI nozzles 19*a,* accordingly it becomes possible to prevent any drive power loss of the first stage rotor disk 13. Moreover, since the structure arranges for the sealing air flow for sealing between the first stage stationary blades 11 and the first stage moving blades 12 to flow through the seal gas supply flow conduits 19*b,* thus there is no interference with the swirling state of the cooling air flow F4 which is flowing through the TOBI nozzles 19*a*. Accordingly, it becomes possible to prevent any loss of drive power due to the bleed gas which is being supplied towards the first stage rotor disk 13.

In this manner, no loss of drive power is caused, accordingly it becomes possible to prevent any danger of loss of generating power of a generator (not shown in the figures) which is connected to this gas turbine.

The present invention, as described particularly in the claims below, provides the following benefits.

Namely, the gas turbine described in the first aspect utilizes a structure comprising a swirling flow creation section which supplies to the rotor disk bleed gas which has been inputted, after imparting this bleed gas with a swirling flow which rotates in the same rotational direction as that of the rotor disk; and a seal gas supply flow conduit which supplies a portion of this bleed gas to a gap between the stationary blades and the moving blades, bypassing the swirling flow creation section. Since according to this structure the bleed gas which is supplied towards the rotor disk is imparted with a swirling flow by passing through the swirling flow creation section, accordingly it becomes possible to prevent any loss of drive power for the rotor disk. Moreover, the bleed gas flow for sealing between the stationary blades and the moving blades is arranged to flow within the seal gas supply flow conduit, and therefore it does not interfere with the swirling state of the bleed gas which is flowing through the swirling flow creation section. Accordingly, it becomes possible to reduce the loss of drive power due to bleeding gas to the first stage rotor disk.

Furthermore, in the gas turbine described in the second aspect, in addition to the structure specified as above, a structure is utilized in which the swirling flow creation section comprises a plurality of TOBI nozzles which reduce the flow conduit cross sectional area while swirling from the outside in the radial direction towards the inside, around the rotational axis of the rotor disk as a center, and the seal gas supply flow conduit is formed so as to pass between the TOBI nozzles. According to this structure, it is made possible to impart a swirling action to the flow of gas towards the rotor disk in a reliable manner. Furthermore, it becomes possible to supply the bleed gas for sealing to the gap between the stationary blades and the moving blades without hampering this swirling flow.

Moreover, the gas bleeding method for a gas turbine described in the third aspect utilizes a method in which: bleed gas is supplied to the rotor disk after being imparted with a swirling flow which rotates in the same rotational direction as that of the rotor disk, and a portion of the bleed gas is supplied to a gap between the stationary blades and the moving blades, bypassing the swirling flow. According to this gas bleeding method, since the flow of bleed gas is supplied towards the rotor disk after having been imparted with a swirling flow, it becomes possible to reduce the loss of drive power for the rotor disk. Moreover, the bleed gas flow for sealing between the stationary blades and the moving blades does not interfere with the above described swirling flow. Accordingly, it becomes possible to reduce the loss of drive power due to bleeding gas towards the first stage rotor disk.

It should be understood that, although the present invention has been shown and described in terms of certain preferred embodiments thereof, and with reference to the drawings, the various particular features of these embodiments and of the drawings are not to be considered as being limitative of the invention, variations and omissions to the details of any particular embodiment are possible within the scope of the appended claims.

What is claimed is:

1. A gas turbine, comprising:

a plurality of stationary blades arranged in a circular manner on a near side of a turbine casing;

a plurality of moving blades arranged in a circular manner on a near side of a rotor disk adjoining said stationary blades;

a swirling flow generating section configured to generate a swirling bleed gas flow by imparting a swirling flow to a portion of a bleed gas supplied thereto and to supply said swirling bleed gas flow to said rotor disk, wherein said swirling bleed gas flow rotates in the same rotational direction as that of said rotor disk; and a seal gas supply flow conduit configured to supply a remaining portion of said bleed gas to a gap between said stationary blades and said moving blades, bypassing said swirling flow generating section, wherein said seal gas supply flow conduit extends between swirling flow generating members in said swirling flow generating section.

2. A gas turbine, comprising:

a plurality of stationary blades arranged in a circular manner on a near side of a turbine casing;

a plurality of moving blades arranged in a circular manner on a near side of a rotor disk adjoining said stationary blades;

a swirling flow generating section configured to generate a swirling bleed gas flow by imparting a swirling flow to a portion of a bleed gas supplied thereto and to supply said swirling bleed gas flow to said rotor disk, wherein said swirling bleed gas flow rotates in the same rotational direction as that of said rotor disk; and a seal gas supply flow conduit configured to supply a remaining portion of said bleed gas to a gap between said stationary blades and said moving blades, bypassing said swirling flow generating section, wherein said swirling flow generating section has outside, inside, upstream, and downstream regions and comprises a plurality of TOBI nozzles configured to reduce a flow conduit cross sectional area while swirling from the outside in a radial direction towards the inside around a rotational axis of said rotor disk as a center; and wherein a portion of said seal gas supply flow conduit is disposed so as to pass between said TOBI nozzles.

3. A method of bleeding gas for a gas turbine, which comprises a plurality of stationary blades arranged in a ring shape on a near side of a turbine casing, and a plurality of moving blades arranged in a ring shape on a side of a rotor disk adjoining said stationary blades, the method comprising:

generating a swirling bleed gas flow by imparting a swirling flow to a portion of a bleed gas, wherein said swirling bleed gas flow rotates in the same rotational direction as that of said rotor disk;

supplying said swirling bleed gas flow to said rotor disk; and supplying a remaining portion of said bleed gas to a gap between said stationary blades and said moving blades, wherein said seal gas supply flow conduit extends between swirling flow generating members in said swirling flow generating section.

4. A method of bleeding gas for a gas turbine, which comprises a plurality of stationary blades arranged in a ring shape on a near side of a turbine casing, and a plurality of moving blades arranged in a ring shape on a side of a rotor disk adjoining said stationary blades, the method comprising:

generating a swirling bleed gas flow by imparting a swirling flow to a portion of a bleed gas, wherein said swirling bleed gas flow rotates in the same rotational direction as that of said rotor disk;

supplying said swirling bleed gas flow to said rotor disk; and supplying a remaining portion of said bleed gas to a gap between said stationary blades and said moving blades, wherein:

said generating a swirling bleed gas flow further comprises a swirling flow generating section having outside, inside, upstream, and downstream regions and a plurality of TOBI nozzles configured to reduce a flow conduit cross sectional area while swirling from the outside in a radial direction towards the inside around a rotational axis of said rotor disk as a center, and said supplying said remaining portion of said bleed gas further comprises supplying said remaining portion through a flow conduit disposed so as to pass between said TOBI nozzles.

* * * * *